US006752107B2

(12) United States Patent
Kreuter

(10) Patent No.: US 6,752,107 B2
(45) Date of Patent: Jun. 22, 2004

(54) APPARATUS FOR SWITCHING THE OPERATION OF A CHANGE VALVE OF A COMBUSTION ENGINE

(75) Inventor: Peter Kreuter, Aachen (DE)

(73) Assignee: Meta Motoren-und Energie-Technik GmbH (DE)

( * ) Notice: Subject to any disclaimer, the term of this patent is extended or adjusted under 35 U.S.C. 154(b) by 299 days.

(21) Appl. No.: 10/008,632

(22) Filed: Dec. 7, 2001

(65) Prior Publication Data

US 2002/0124820 A1 Sep. 12, 2002

(30) Foreign Application Priority Data

Dec. 7, 2000 (DE) ..... 100 60 890

(51) Int. Cl.[7] ..... F01L 13/00; F01L 1/12; F02D 13/06

(52) U.S. Cl. ..... 123/90.16; 123/90.17; 123/90.41; 123/198 F

(58) Field of Search ..... 123/90.15, 90.16, 123/90.17, 90.39, 90.41, 90.42, 90.43, 90.44, 90.6, 198 F

(56) References Cited

U.S. PATENT DOCUMENTS 5,655,488 A * 8/1997 Hampton et al. ..... 123/90.16
6,032,624 A * 3/2000 Tsuruta et al. ..... 123/90.16
6,318,317 B1 * 11/2001 Hubschle ..... 123/90.16
6,321,705 B1 * 11/2001 Fernandez et al. ..... 123/90.16
6,325,030 B1 * 12/2001 Spath et al. ..... 123/90.16

FOREIGN PATENT DOCUMENTS

| | | |
|---|---|---|
| DE | 3526542 | 2/1986 |
| DE | 3701480 | 7/1987 |
| DE | 198 28 945 | 1/2000 |
| EP | 0 016 068 | 10/1980 |
| EP | 0 995 885 | 4/2000 |

* cited by examiner

*Primary Examiner*—Weilun Lo
(74) *Attorney, Agent, or Firm*—R W Becker & Associates; R W Becker

(57) ABSTRACT

An apparatus for converting or changing the operation of a charge valve of a combustion engine, which comprises a camshaft with at least one valve cam, a swing lever supported on a machine-mounted component, which comprises a contact element for maintaining a contact member in a disposition on the valve cam and which actuates the valve, a coupling member mounted on the swing lever, which, in a first position, translates a movement of the contact member via the valve cam to the swing lever and, in a second position, interrupts the movement translation, and a switch device for moving the coupling member between its first and second positions and retaining apparatus mounted on the swing lever for retaining the coupling member in its second position.

9 Claims, 7 Drawing Sheets

APPARATUS FOR SWITCHING THE OPERATION OF A CHANGE VALVE OF A COMBUSTION ENGINE

BACKGROUND OF THE INVENTION

The present invention relates to an apparatus for switching the operation of a charge valve of an internal combustion engine according to the main concept of the principal claim.

A reduction in the consumption of combustion fuel has, in recent times, assumed increasing importance. One possibility to thus reduce combustion fuel consumption, offered in connection with multiple cylinder motors, is the timed placement out of service of individual cylinders, whereby the remaining cylinders operate with a higher average pressure and, thereby, a reduced specific fuel consumption. To place a cylinder out of operation, not only an interruption of the combustion fuel delivery is required; as well, the charging flow to the corresponding cylinder must also be deliberately interrupted, in that the one or more charging valves, especially the inlet or intake valves, of the respective cylinder are placed out of operation.

A further, important development goal lies in the reduction or decrease of the pollutant content in the exhaust gasses. The starting points for such improvements are to be found in the valve opening functions which are accommodated to the respective operational ranges, whereby optimal combustion conditions can be achieved.

In view of the above-noted reasons, there is a strong need for an adjustable or, respectively, convertible valve operating apparatus.

DE 19 82 8945 A1 discloses an apparatus for the activation and complete de-activation of a charging valve. In connection with this apparatus, the retention of a coupling lever, whose position determines the activation or de-activation of the valve, is effected by means of an electro-magnet disposed in a motor housing or on the cylinder head. In total, this known apparatus requires modifications of the motor housing or the cylinder head, in order to be subsequently installed thereon at a post-engine manufacturing time.

EP 0 016 068 describes an apparatus for converting the operation of a charging valve of a combustion powered engine, which works with a swing lever and a contact lever disposed in contacting relation with the swing lever. A spring, which presses the contact lever into a following disposition on the camshaft, is supported between the swing lever and the contact lever, so that, in this regard, no modification of the cylinder head via a subsequent installation effort is required. The actuation and retaining apparatus for actuating the coupling member is, however, configured as a hydraulic cylinder mounted on the cylinder head or, respectively, the motor housing, the hydraulic cylinder having a tappet which engages a contact surface of a coupling lever which is secured in a non-rotating manner with the coupling member, so that a friction contact occurs between the tappet and the contact surface. The arrangement according to EP 0 016 068 requires, in total, considerable installation room and is, especially because of the hydraulic cylinder, not capable of being subsequently installed on the cylinder head without a necessary modification thereof.

EP 0 995 885 A2 describes a valve actuating mechanism with an outer swing lever for engagement with a cam during the high stroke thereof and an inner swing lever for engagement with a cam during a lower stroke thereof. The ends of the swing lever disposed adjacent the charge valve of a combustion engine are connected to one another via connecting taps. On the other ends of the swing lever, a locking mechanism is provided, which comprises a pin which is movable back and forth between a locking position and a release position.

DE 37 01 480 A1, which describes the state-of-the-art apparatus which is improved upon by the apparatus of the present invention describes a valve actuating system in which the spring which biases the contact lever in the direction of a disposition of the contact lever onto the cam is supported on the cylinder head. This means that an available cylinder head for the subsequent installation of the valve actuating system must be modified, which is expensive. Moreover, a hydraulic cylinder with a tappet is provided for the release, or respectively, the blocking, of the movement which is translated between the contact lever and the swing lever, with the hydraulic cylinder being provided with hydraulic fluid via a hydraulic element on which the swing lever is supported and the swing lever requiring bores, which are expensive to provide, for permitting passage therethrough of the hydraulic fluid.

The present invention inventively provides a solution which advances the state-of-the-art apparatus, in that it has a simple configuration for a conventional combustion engine and can be installed thereon with the least possible modification while providing a high measure of operational reliability.

SUMMARY OF THE INVENTION

In accordance with the present invention, the spring which biases the contact lever in a direction into a disposition of the contact lever on the valve cam extends directly between the swing lever and the contact lever so that, in this regard, no modification of the cylinder head is required.

Furthermore, the respective movement of the coupling member of the apparatus into its first and second positions is deliberately and synchronously effected by the rotation of the camshaft, so that the coupling member need only be retained in its second position. This permits a simple configuration of the retaining apparatus.

BRIEF DESCRIPTION OF THE DRAWINGS

The invention is described in the following description in connection with the schematic drawings and is explained in further details therewith.

The Figures of the drawings show.

DESCRIPTION OF PREFERRED EMBODIMENTS

Figure 1:
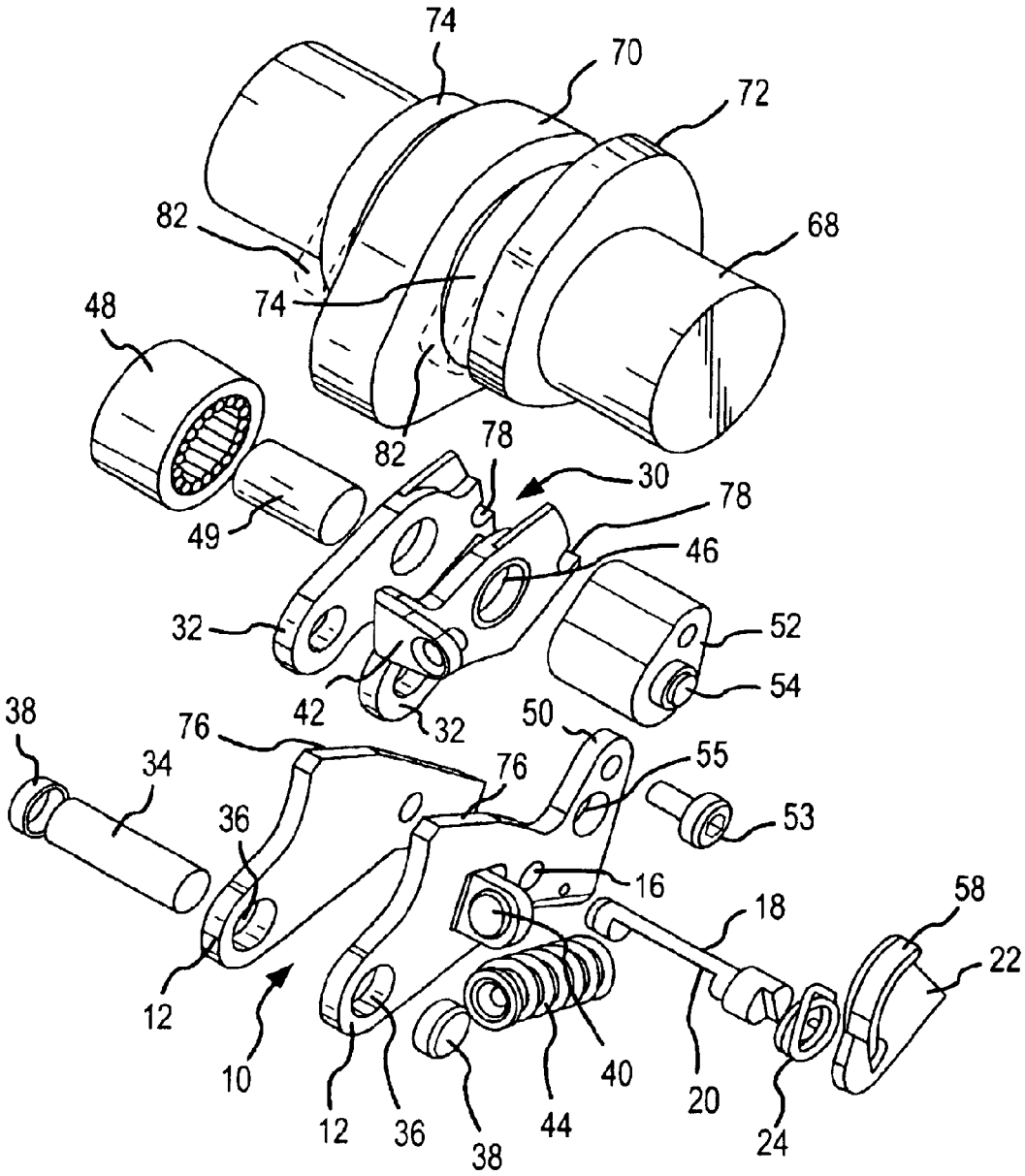
FIG. 1 is a first embodiment of the inventive apparatus in an exploded perspective view.

In all of the hereinafter following figures, functionally similar building components are designated with the same reference characters.

Figures 2, 3, 4:
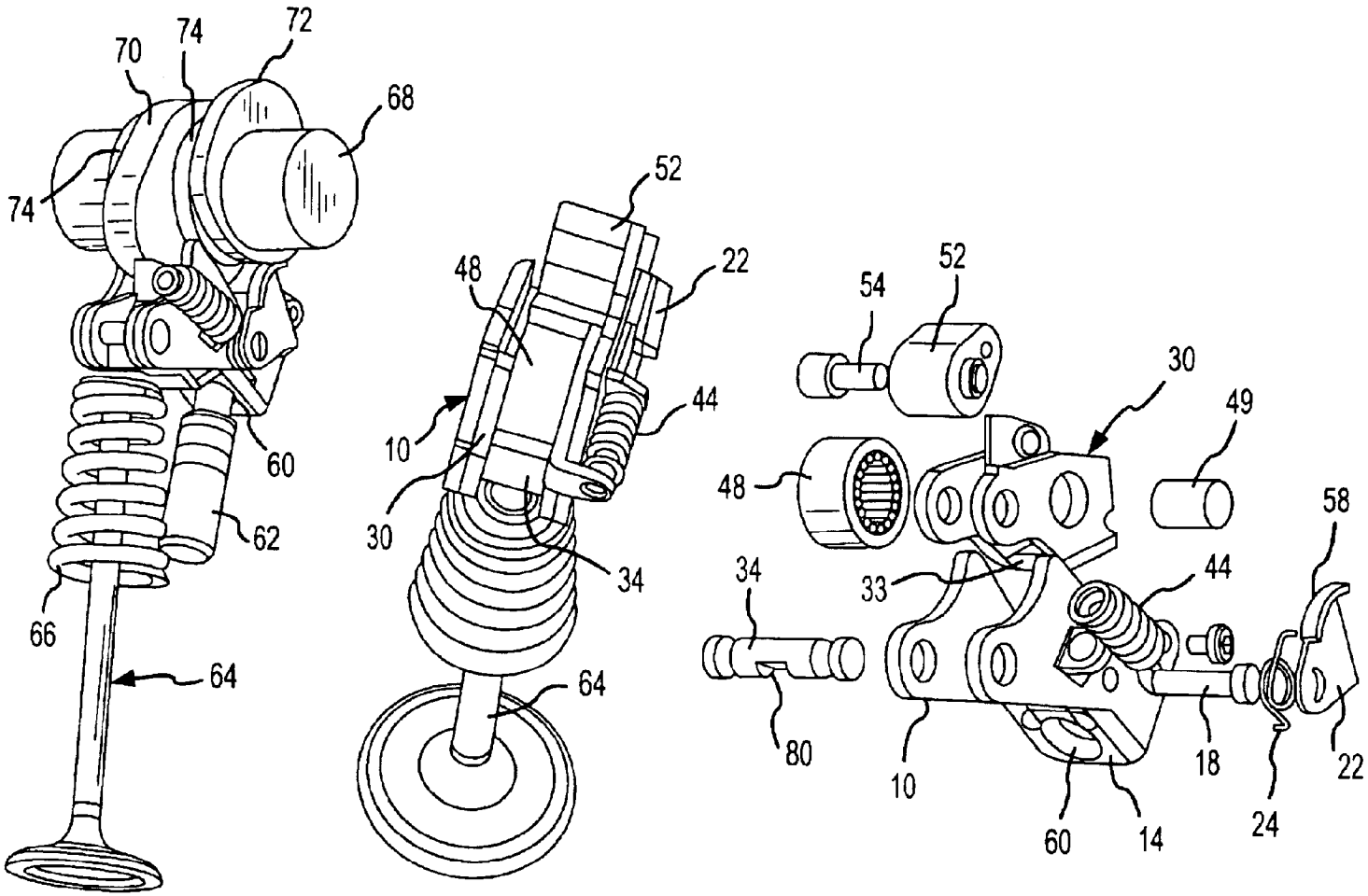
FIGS. 2 and 3 are two perspective views of the assembled apparatus shown in FIG. 1.
FIG. 4 shows the arrangement of FIG. 1 at a different view thereat of the exploded perspective illustration of the arrangement.
Figure 6:
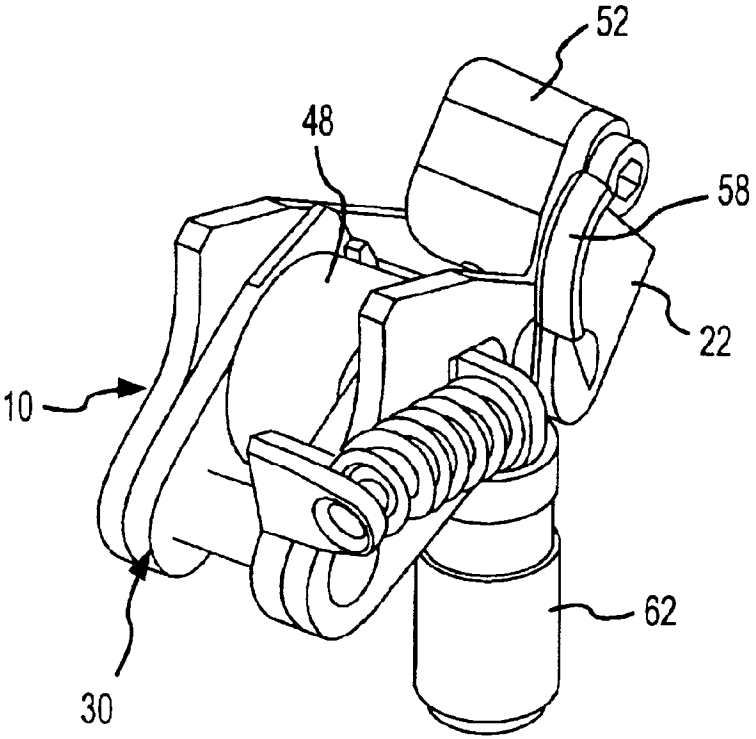
FIGS. 5 and 6 are two perspective views of the embodiment shown in FIG. 1 from different viewpoints.
Figure 5:
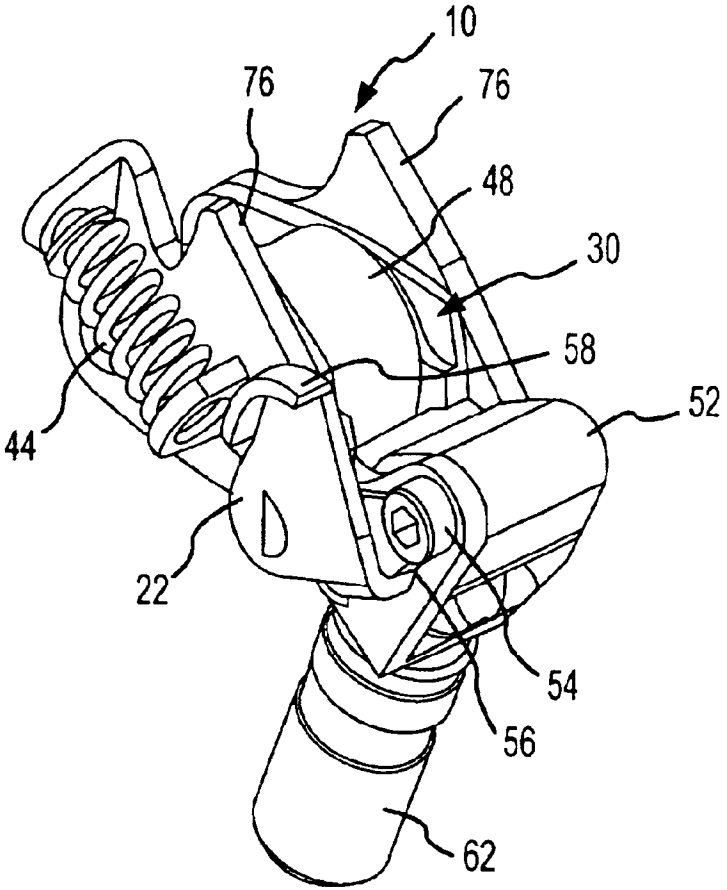

As seen in FIGS. 1 to 3, a swing lever, which is collectively designated with the reference character 10, comprises two swing arms 12 extending parallel to one another which are rigidly connected to one another at their lower rear portions via a flange 14 (FIGS. 4 and 5) or are, respectively, unitarily connected with this flange. The swing lever arms, in their rear regions in the vicinity of the flange 14, are provided with holes 16, in which a coupling bolt 18 is rotatively mounted, the coupling bolt having a cut out 20. A coupling lever 22 is secured in a non-rotating manner to the coupling bolt 18, the coupling lever being biased, in the installed condition of the coupling bolt 18 in the swing lever 10, in a counter clockwise direction by a rotation spring 24 connected to the coupling lever and the swing lever 10.

A contact lever, which is collectively designated with the reference character 30 is, in a manner similar to the swing lever 10, configured with two contact lever arms 32, which are rigidly connected to one another by a flange 33 (FIG. 4) or, respectively, are unitarily rigidly connected with one another.

The contact lever 30 is dimensioned such that it is receivable between the arms of the swing lever 10. By means of a bolt 34, which extends through pivot openings 36 at the forward end of the arms 12 and 32 and, as desired, is rotatably disposed therein via bushings 38, the contact lever 30 is rotatable relative to the swing lever 10. In the assembled condition of the swing arm 10, a spring 44 is arranged between an appendage 40 projecting from the swing arm 10 and a bracket 42 provided on the contact lever 30, the spring 44 biasing the contact lever 30 for a swing movement in the counter-clockwise manner relative to the swing lever 10.

The contact lever arms 32 are provided at spacings from the pivot openings 36 with each having a respective additional pivot opening 46, the pivot openings 46 securing between the arms 32 a rotation bolt 49 (FIG. 4) on which a contact roll or roller 48 is mounted.

On the right-hand swing lever arm 12, as seen in FIG. 1, an extension 50 is provided on which an electromagnet 52 is mounted between the two arms 12 by means of a screw 53, the electro-magnet comprising an electro-magnetically actuable blocking bolt 54 which can be extended outwardly into a hole 55 formed in the extension 50 and which cooperates with an appendage 56 (FIG. 14) of the coupling lever 22. The coupling lever 22 comprises a contact surface 58 whose function is explained in more detail hereinafter.

The assembly of the above-described apparatus is as follows:

The coupling bolt 18 is assembled together with the coupling lever 22 and, with the intermediate arrangement of the rotational spring 24, is extended through the holes 16 and axially non-displaceably secured to the swing lever 10. The contact roller 48 is disposed on the contact lever 30 and the contact lever 30 is, via the bolt 34, disposed on the swing lever 10. The electro-magnet 52 is mounted to the extension 50 and is connected via non-illustrated connectors with a control device.

The entire working assembly, with the flange 14 of its swing lever 10 having one or more corresponding cut outs 60, is disposed on a hydraulic power compensating element 62 which itself is on the cylinder head of a non-illustrated combustion engine, whereby the bolt 34 comes into contact with the shaft of a valve 64 which is pressed in its closing direction by a return spring 66.

Thereafter, a camshaft 68 is installed which comprises a valve cam 70 for contacting the contact roller 48 and a coupling cam 72, which cooperates with the contact surface 58 of the coupling lever 22. As can be seen, the coupling cam 72 is arranged relative to the valve cam 70 such that the radially raised portion of the coupling cam is angularly coincident with the region of the base circle of the valve cam 70. The camshaft 68 includes circular cylindrical contact surfaces 74 disposed on both sides of the valve cam which cooperate with the outer surface regions 76 of the swing lever arms 12.

The arrangement between the cut out 20 in the coupling bolt 18, the rotational position of the coupling lever 22 or, respectively, the rotational position of the coupling bolt 18, and the arms 32 of the contact lever 30 is such that the arms of the contact lever 30 can pass through the cut out 20 of the coupling bolt 18, if the coupling lever 22 is disposed in the position into which it moves in a clockwise direction, as shown in FIG. 1, due to the engagement of the coupling lever by the radially raised portion of the coupling cam 72. If the coupling lever 22, in contrast, is disposed in the position it assumes as it follows the base circle of the coupling cam 72, the cut out 20 will have been rotated such that the arm 32 of the contact lever 30 cannot move past the cut out 20 but is, instead, as a result of the seating engagement between the coupling bolt 18 and the cut out 78 formed in the arm 32, disposed in a form locking or keyed manner with the coupling bolt 18 so that the contact lever 30 cannot swing away from the swing lever 10.

The arrangement between the outer surface region 76 of the swing lever arm 12 and the contact surface 74 of the camshaft 68 is such that the bolt 34 is constantly in at least adjacent disposition to the valve shaft, even if the contour of the valve cam 70 is not translated by the contact lever 30 to the swing lever 10.

The function of the above-described apparatus is as follows:

It is assumed that the electro-magnet 52 is not actuated, so that the blocking bolt 52 does not extend through the hole 55 formed in the extension 50. If the valve cam 70 presses the contact roller 48 downwardly, as viewed with respect to FIG. 1, the movement of the contact roller 48 is translated to the swing lever 10 due to the seating engagement between the contact lever 30 and the coupling bolt 18, whereby the bolt 34 actuates the valve 64.

The entire arrangement is disposed such that, as a result of the biasing force of the tolerance compensating element 62, the contact roller 48 is disposed on the base circle of the valve cam 70 or, respectively, the outer surface region 76 of the swing lever arm 12 is disposed on the contact surface 74 of the camshaft 68. If, during the effective operation of the base circle of the valve cam 70, the coupling cam 72 engages the contact surface 58, the coupling bolt 18 is rotated such that the cut out 20 rotates toward the arms of the contact lever 30 without the arms initially passing through the cut out. If the coupling lever 22 is retained by the actuation of the electro-magnet 52 through the rotational position of the radially raised portion of the coupling cam 72 (the blocking bolt 54 of the electro-magnet 52 grips or contacts the appendage 56 of the coupling lever 22), the contact lever 30 can, during the thereafter-following actuation, be moved by the valve cam 70 through the cut out 20 and thereby swing into the swing lever 10, so that the valve 64 is not actuated.

It is to be understood that the electro-magnet 52 is respectively actuated by a non-illustrated control device at least for capturing or, respectively, retaining, the coupling lever 22, if the contact roller 48 has contacted the base circle of the valve cam 70 or, respectively, has contacted the base circle of the coupling cam 72 as the coupling lever 22 is rotated in the clockwise direction as shown in FIG. 1.

As can be understood from the foregoing description, the entire described building components can be mounted in a simple manner on the cylinder head before the installation of the camshaft instead of the mounting of a conventional valve actuating lever, whereby the cut out 60 formed in the flange 14 provides for a secure and reliable securement of the building components on the tolerance compensating element 62 and a cut out 80 formed in the bolt 34 and opening toward the valve shaft provides for a flat disposition on the valve shaft.

The afore-described arrangement can be reconfigured or modified in many ways: for example, the coupling bolt 18 can be provided with two cut outs 20 each of which corresponds to one of its arms. Furthermore, the coupling bolt 18 and the contact lever 30 can be configured such that the contact lever in one of the rotational positions of the coupling bolt lies against the coupling bolt and, in another rotational position, moves past the coupling bolt.

As seen in FIG. 1, in individually depicted broken-line positions, the cylindrical contact surfaces 74 are provided with assistance cams 82. In one configuration of the camshaft 68 with such assistance cams 82, in the event of a "captured" coupling lever (interruption of the movement translation between the contact roller 48 and the swing lever 10), the swing lever 10 is immediately or directly actuated by the assistance cams, which are disposed on the cuter surface regions 76. In this manner, the valve 64 can be actuated with two different opening functions corresponding to the valve cam 70 and the assistance cams 82.

Figure 8:
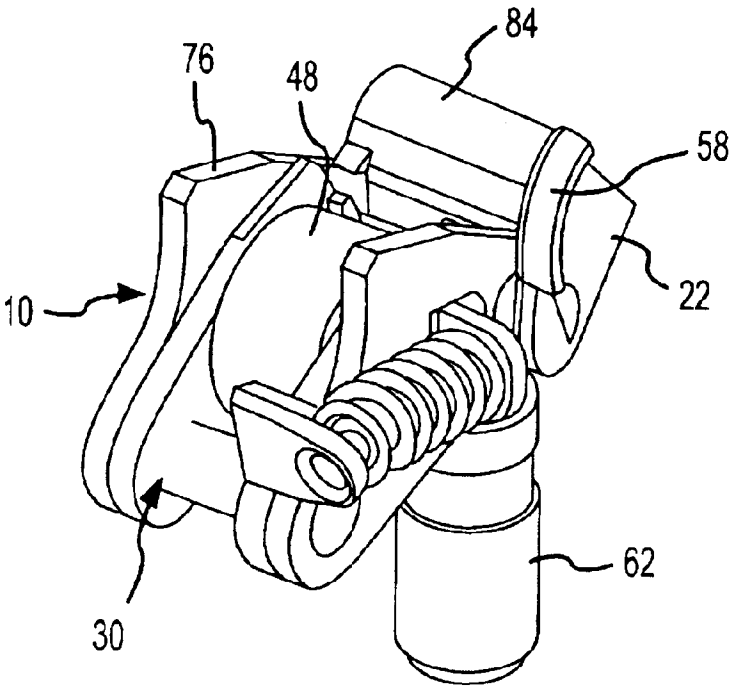
FIGS. 7 and 8 show a modified embodiment of the apparatus in perspectives similar to those shown, respectively, in FIGS. 5 and 6, FIGS. 9 and 10 are perspective views similar to those of FIGS. 2 and 3 of a modified embodiment of the inventive apparatus.
Figure 7:
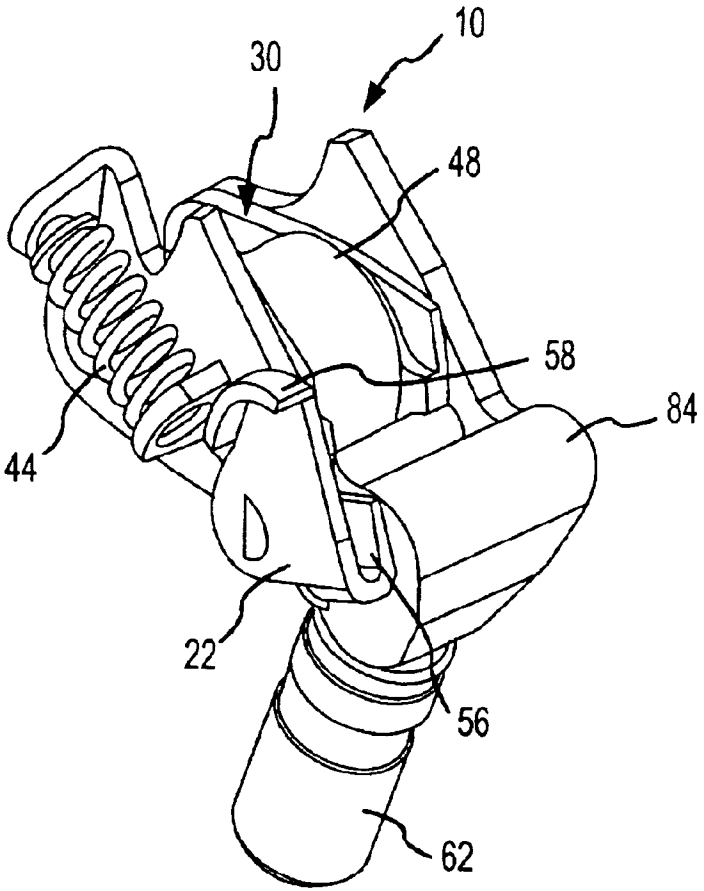
Figure 11:
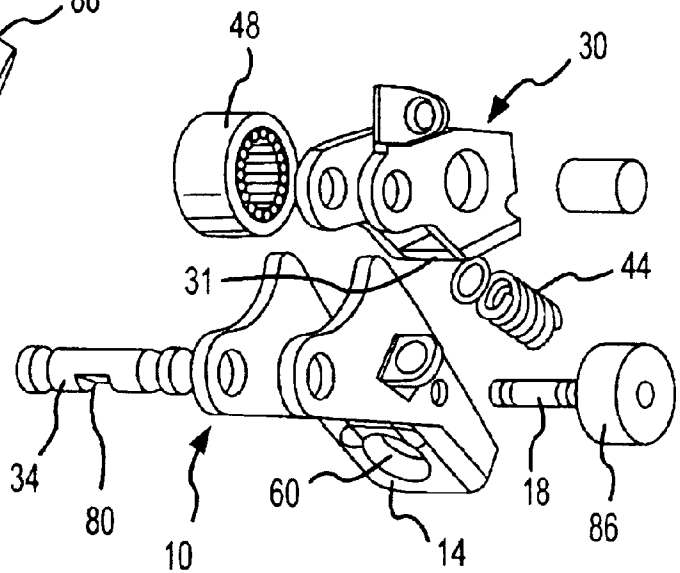
FIG. 11 shows the embodiment of the apparatus as shown in FIGS. 9 and 10 in an exploded perspective view.
Figure 10:
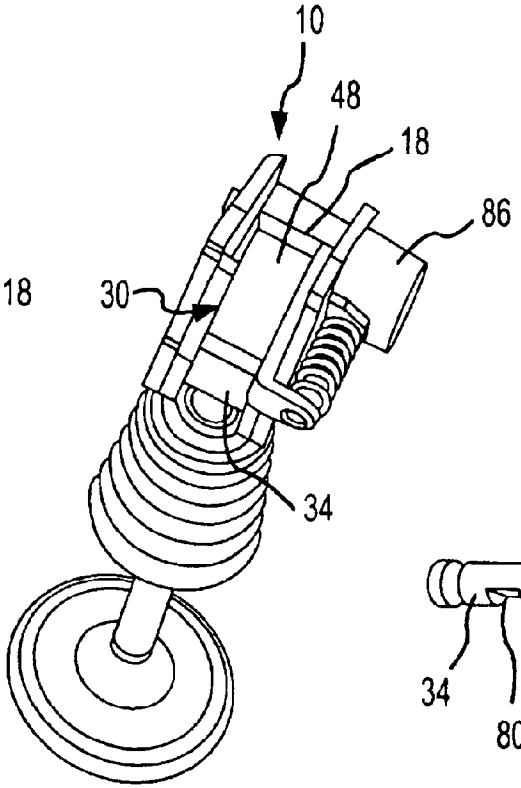
Figure 9:
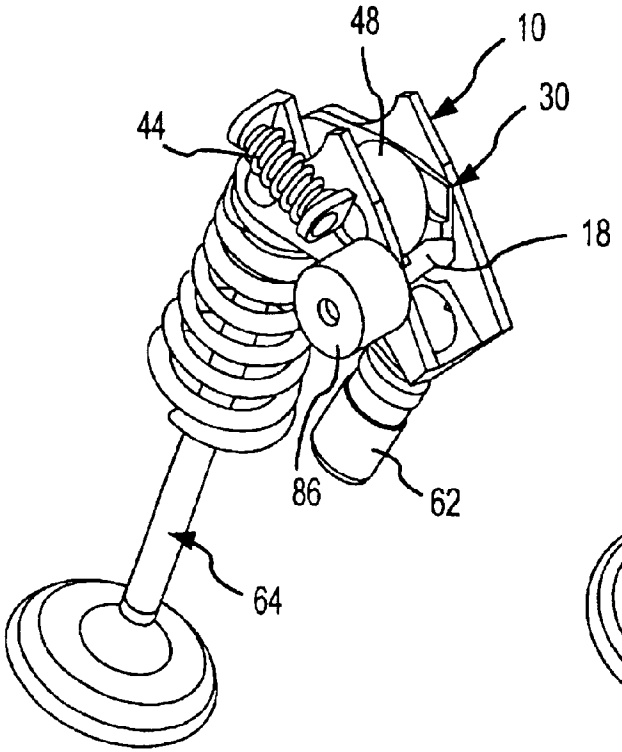

FIGS. 7 and 8 show an embodiment which, relative to the afore-described embodiment, is only slightly modified. The difference lies in that the electro-magnet 52 of the previously described embodiment is replaced by a hydraulic cylinder 84 so that the blocking bolt 54 for capturing, or respectively, fixedly retaining, the coupling lever 22 is hydraulically actuated. The hydraulic pressure can be directly absorbed by the tolerance compensating device 62, whereby the hydraulic cylinder 84 can be configured such that it captures the coupling lever 82 at a high hydraulic pressure or at a low hydraulic pressure and fixedly retains the coupling lever, or respectively, releases the coupling lever. It is to be further understood that, as well in this embodiment as in the previously described embodiment, the coupling lever 22 can be configured with a ramp extending to the blocking bolt 54 on which the extended-out blocking bolt 54 is disposed and which thereby captures the coupling lever 22, if the coupling lever has been moved by the coupling cam 72 in the clockwise direction into its respective position in which the movement translation between the contact roller 48 and the valve actuation bolt 34 has been interrupted.

Figure 12:
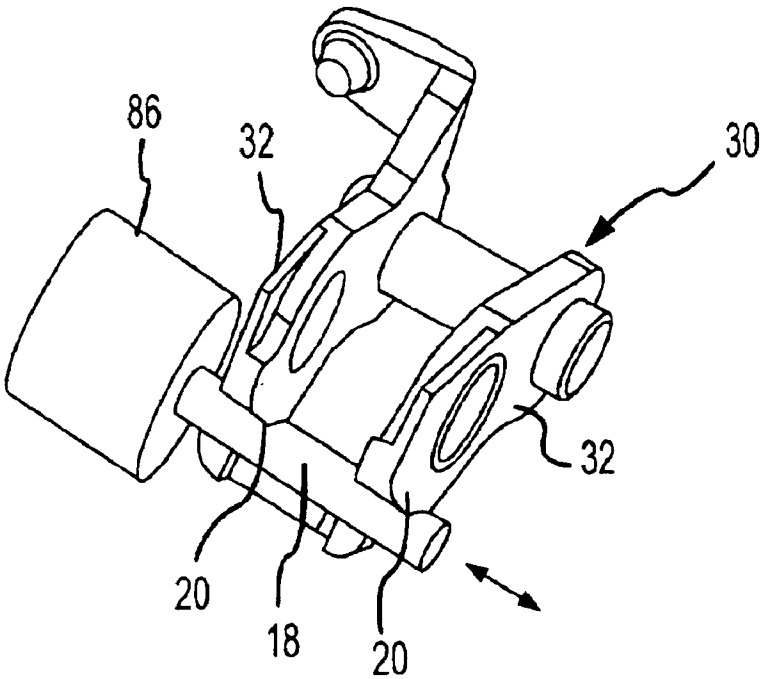

A further embodiment of the inventive apparatus is shown in FIGS. 9–13. This embodiment is distinguished from the previous embodiments in that the coupling bolt 18 is not, as in the previous embodiments, rotatable, but, rather, is displaceably supported in the swing lever arms 12, and the actuation or switch device 86, which is configured as an electromagnet or a hydraulic cylinder and secured to the swing arm 10, is displaced in the direction of the double arrows shown in FIG. 12. As seen in particular in FIGS. 12 and 13, the coupling bolt 18, which has two cut-outs 20, is in its first position, as shown in FIG. 12, whereby, in this position, the coupling bolt is displaced axially such that the cut outs 20 are to the side relative to the contact lever arms 32 of the contact lever 30, so that the contact lever 30 is in form locking or keyed engagement with the coupling bolt 18 and a swing movement of the contact lever 30 is translated to the swing lever 10.

Figure 13:
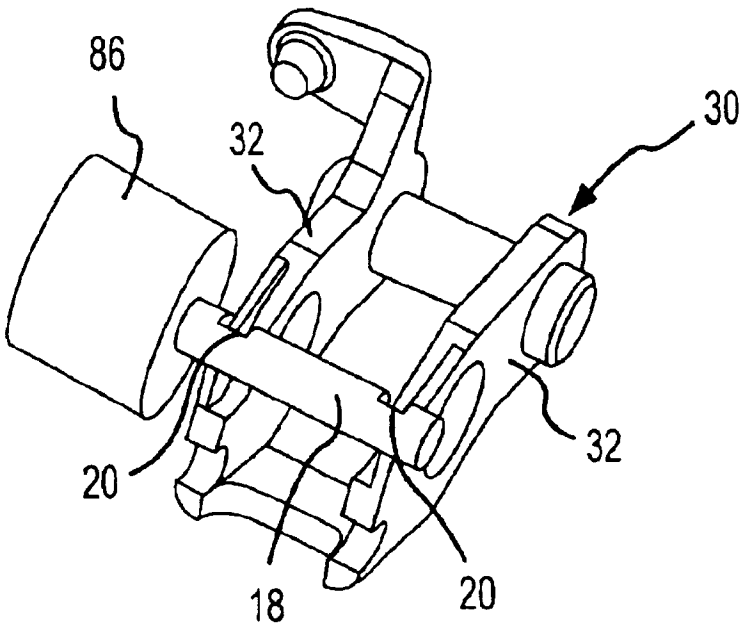
FIGS. 12 and 13 show several functional components of the apparatus according to the two different positions of the coupling member shown in FIGS. 9–11.

As seen in FIG. 13, the coupling bolt 18 can be displaced toward the left out of its position as shown in FIG. 12 so that the cut outs 20 are located in the region of the contact lever arms 32 and the contact lever 30 can pass through the coupling bolt 18, such that a swing movement of the contact lever 30 via the valve cam 70 does not correspondingly take along the swing lever 10, in which the coupling bolt 18 is supported, and the valve is correspondingly not actuated.

It is to be understood that the actuation of the switch unit 86 in accordance with the embodiment shown in FIGS. 9–13 is preferably synchronized with the camshaft rotation such that the switch unit 86, if the valve is to be placed out of operation, is actuated while the contact roller 48 is in following contact with the base circle of the valve cam 70. Similarly, the valve in this phase position is again turned off or de-activated.

In the embodiment shown in FIGS. 9–13, the camshaft 68 does not support any coupling cams so that this embodiment can be installed on conventional cylinder heads without any modification.

The invention can be altered or reconfigured in many ways. In this regard, individual ones of the afore-described features can be combined with one another and/or can additionally be reconfigured. For example, the coupling bolt 18 in the embodiment shown in FIGS. 9–13 can, as well, be rotatable. Furthermore, the bolt 34 need not necessarily or invariably directly actuate the valve; instead, the swing lever can be configured with an additional flange which actuates the valve. Additionally, the configuration of the swing lever can be such that the swing lever simultaneously actuates two valves such as, for example, two inlet valves. The retaining or, respectively, capture, device for the coupling lever 22 can be configured in the form of an electro-magnet which operates to immediately or directly capture the coupling lever 22, which is configured as an anchor, and so forth. The coupling member can be configured integrally or unitarily with the coupling lever. The cut outs 20 can be replaced through any other embodiment by which a form locking can be achieved and which is releasable.

Figure 14:
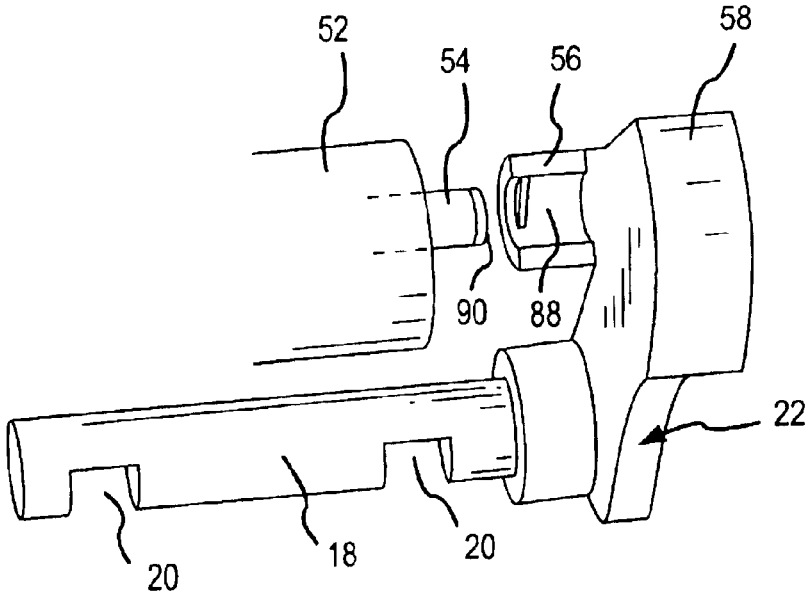
FIG. 14 is a detailed view of the engagement between a blocking bolt and a coupling lever.

FIG. 14 shows an advantageous detail of the blocking bolt on the appendage on the coupling lever 22 as it is shown, for example, with regard to the embodiment shown in FIGS. 1–8: the appendage 56 of the coupling lever is provided with ribs 88 which can seat in an annular groove 90 formed in the blocking bolt. If the coupling lever 22 is moved by the coupling cam in accordance with FIG. 14 to the rear to the widest possible extent, the blocking bolt 54 is moved toward the right and maintains the coupling lever in a retained position during its subsequently falling forward movement, whereby the blocking bolt is blocked by virtue of the engagement between the ribs 88 and annular groove 90 from making a movement toward the left as shown in FIG. 14. Correspondingly, the electro-magnet need not be activated to engage the blocking bolt as long as this engagement exists. The engagement releases, in turn, if the coupling lever moves into contact with the apex or radially outermost portion of the coupling cam. An advantage which is achieved with the embodiment according to FIG. 14 is that the signal to the actuator the electro-magnets 52 to lock or release can be given in a wide range and is substantially independent of the angle position of the camshaft. The locking and releasing follows always through a predetermined angular range of the coupling cam.

Figure 15:
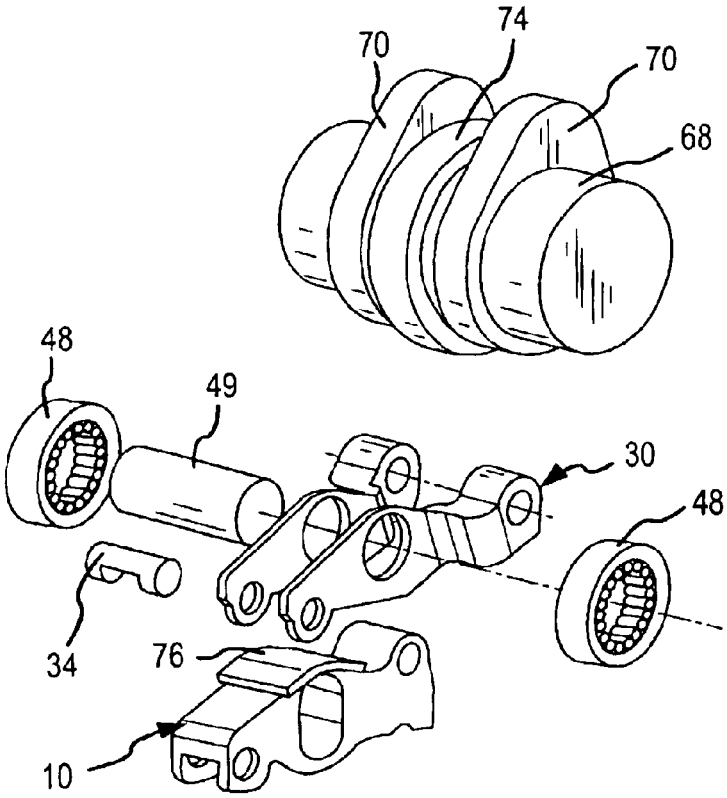
FIG. 15 is an exploded view of a further embodiment of the inventive apparatus.

FIG. 15 shows a changed or reconfigured construction of the swing lever, the coupling lever, and the camshaft. In this embodiment, the swing lever is arranged within the contact lever 30. The rotational support bolt 49, which rotatably supports the pair of contact rollers 48 each on a side of the contact lever 30, extends through a large opening of the swing lever 10. The outer surface region 76 of the swing lever 10, which cooperates with a cylindrical contact surface 74 of the camshaft 68, is centrally disposed on the swing lever. The camshaft 68 is correspondingly configured with a cylindrical contact surface 74 and two valve cams 70. Also, in the embodiment according to FIG. 15, a coupling cam and a corresponding coupling lever can be provided, these components not being shown. The arrangement according to FIG. 15 can, for example, then be advantageous if the free access to the seat of the valve spring in the non-actuated position is very limited.

The specification incorporates by reference the disclosure of German priority document 100 60 890.6-13 filed on Dec. 7, 2000.

The present invention is, of course, in no way restricted to the specific disclosure of the specification and drawings, but also encompasses any modifications within the scope of the appended claims.

What is claimed is:

1. An apparatus for selectively enabling and disabling the operation of a charge valve of an internal combustion engine, comprising:

a cam shaft having a rotation axis;

a coupling cam and at least one valve cam each mounted to the cam shaft for rotation therewith, the coupling cam and the valve cam each having a cam profile comprising a follower displacing portion extending to the radially outermost location of the profile relative to the cam shaft rotation axis and a dwell portion at a lesser radial distance from the cam shaft rotation axis than the follower displacing portion;

a swing lever having one portion supported on a component of the internal combustion engine;

a contact lever movably mounted to the swing lever at a first location thereon spaced from the one portion of the swing lever;

contact lever biasing means for biasing the contact lever into contact with the valve cam, the contact lever biasing means having one end connected to the swing lever and another end connected to the contact lever;

a coupling member movably supported by the swing lever at a second location thereon spaced from the first location on the swing lever at which the contact lever is movably mounted, the coupling member including a bolt rotatably mounted in the swing lever and the coupling member being movable between a non-interfering position in which the contact lever, in response to engagement thereof by the follower displacing portion of the valve cam, moves, without interference from the coupling member, into contact with the swing lever to thereby impart a movement to the swing lever which enables the operation of the charge valve and a blocking position in which the coupling member blocks contact between the contact lever and the swing lever such that the contact lever cannot impart movement to the swing lever;

coupling member biasing means for biasing the coupling member into contact with the coupling cam, the coupling member biasing means having one end connected to the swing lever and another end connected to the coupling member; and means for releasably maintaining the coupling member in its blocking position, the follower displacing cam profile portion of the valve cam and the follower displacing cam profile portion of the coupling cam being angularly offset from one another relative to the cam shaft rotation axis such that the follower displacing cam profile portion of the coupling cam displaces the coupling member from its non-interfering position into its blocking position during a rotating movement of the cam shaft during which the contact lever follows the dwell portion of the valve cam.

2. An apparatus according to claim 1, wherein the swing lever includes a pair of swing lever arms at a spacing from one another through which the contact lever moves, the swing lever arms being connected to one another by a flange and the contact lever includes a pair of contact lever arms interconnected to one another by a flange on which is mounted a contact roller adapted for following movement along the cam profile of the valve cam.

3. An apparatus according to claim 2, wherein the contact lever arms are rotatably mounted on the swing lever arms by a bolt, the bolt contacting the charge valve to thereby move the charge valve.

4. An apparatus according to claim 2, wherein the coupling member includes at least one cut out dimensioned to permit movement of the contact lever arms therethrough in the non-interfering position of the coupling member.

5. An apparatus according to claim 1, wherein the means for releasably retaining the coupling member in its blocking position includes an electro-magnet.

6. An apparatus according to claim 1, wherein the means for releasably retaining the coupling member in its blocking position includes an axially displaceable blocking bolt which is axially displaceable into an axially displaced disposition in which the blocking bolt blocks the path of movement of an appendage of the coupling member, the blocking bolt and the appendage of the coupling member cooperating with one another in the axially displaced disposition of the blocking bolt such that the blocking bolt is prevented from movement out of its axially displaced disposition.

7. An apparatus according to claim 1, wherein the cam shaft includes a cylindrical surface which the swing lever follows while the coupling member is in its blocking position.

8. An apparatus according to claim 1, wherein the cam shaft includes an assistance cam which moves the coupling member into a second non-interfering position in which the contact lever moves, without interference from the coupling member, into contact with the swing lever to thereby impart a movement to the swing lever which enables the operation of the charge valve, the assistance cam moving the coupling member into its second non-interfering position at a different angular position of the cam shaft than the angular position of the cam shaft at which the coupling member is moved into its non-interfering position by the coupling cam.

9. An apparatus according to claim 1, wherein the component of the internal combustion engine on which the one portion of the swing lever is supported is a hydraulic compensating element.

* * * * *

UNITED STATES PATENT AND TRADEMARK OFFICE

CERTIFICATE OF CORRECTION

PATENT NO. : 6,752,107 B2
DATED : June 22, 2004
INVENTOR(S) : Kreuter

It is certified that error appears in the above-identified patent and that said Letters Patent is hereby corrected as shown below:

Title page,
Item [54], Title, should read as follows:
-- [54] Title: APPARATUS FOR SWITCHING THE OPERATION OF A CHARGE VALVE OF A COMBUSTION ENGINE --

Signed and Sealed this

Seventeenth Day of August, 2004

JON W. DUDAS
*Acting Director of the United States Patent and Trademark Office*